United States Patent [19]

Fujita et al.

[11] Patent Number: 5,062,986

[45] Date of Patent: Nov. 5, 1991

[54] FILM-SHAPE SOAP

[75] Inventors: Takeshi Fujita; Chuzo Isoda, both of Uji; Kazuyo Aketa, Kyoto, all of Japan

[73] Assignee: Dai-Ichi Kogyo Seiyaku Co., Ltd., Kyoto, Japan

[21] Appl. No.: 505,471

[22] Filed: Apr. 6, 1990

[30] Foreign Application Priority Data

Apr. 20, 1989 [JP] Japan ..... 1-101163

[51] Int. Cl.[5] ..... C11D 17/06; C11D 7/04

[52] U.S. Cl. ..... 252/134; 252/108; 252/174; 252/174.21; 252/174.23; 252/DIG. 16

[58] Field of Search ..... 252/134, 174, 174.23, 252/DIG. 16, 108, 174.21

[56] References Cited

U.S. PATENT DOCUMENTS 3,293,684 12/1966 Tundermann ..... 252/92

FOREIGN PATENT DOCUMENTS 55-133497 10/1980 Japan ..... 252/174
0165998 12/1980 Japan ..... 252/134
62-43497 2/1987 Japan ..... 252/134

*Primary Examiner*—Paul Lieberman
*Assistant Examiner*—Alexander G. Ghyka
*Attorney, Agent, or Firm*—Stevens, Davis, Miller & Mosher

[57] ABSTRACT

The present invention relates to a film-shape soap comprising (a) a water soluble polymer and (b) a soap; said water soluble polymer is a polyester of polyether polyol having an average molecular weight of more than about 1,000 and a polycarboxylic acid, and has a weight average molecular weight of not less than about 20,000, which has a rapid soluble time in water in spite of a lower equilibrium moisture content, excellent washability, little stimulation to a skin, flexible (not brittle) and stable properties, and is suitable for a portable type toilet soap, disposable soap and the like.

5 Claims, No Drawings

FILM-SHAPE SOAP

BACKGROUND OF THE INVENTION

The present invention relates to a film-shape soap.

It is 60 years since a film-shape soap, so called "paper soap" was known, but the classical paper soap was too brittle to be practically used.

Recently, the demand of a film-shape soap has become increased for portable use, disposable use, unit usage, and so on, especially as the sanitary sense has become more popular. In order to improve the brittleness of the classical paper soap it has been tried the addition of various kinds of a film formable polymer material into the soap. Most of these trials, however, have been failed due to the incompatibility of the soap with a conventional film formable polymer material and the high melting point of the soap itself.

Japanese Patent Application KOKAI No.53-91912 discloses a film-shape detergent using a synthetic detergent which is comparatively easy to prepare a film instead of soap and methyl cellulose as a film forming material. For this film-shape detergent obtained, however, have been pointed out many defects attributed to the synthetic detergent such as the cause of hand chapping, poor solubility in water, hard or stimulus feeling to hand in use and so on. Therefore, it has been desired the development of a film-shape soap using a soap itself which is mild to a skin, and has no stimulation.

SUMMARY OF THE INVENTION

The present invention provides a film-shape soap, which is useful for portable use, disposable use, unit usage and the like. The film-shape soap of the present invention comprising (a) a water soluble polymer and (b) a soap; said water soluble polymer is a polyester of polyether polyol having a weight average molecular weight of more than about 1,000 and a polycarboxylic acid, and has a weight average molecular weight of not less than about 20,000.

The polymer used in the present invention has an excellent compatibility with a soap and can give a thin layer soap when mixed with a soap.

DETAILED DESCRIPTION OF THE INVENTION

The present invention relates to a film-shape soap which comprises (a) a water soluble polymer and (b) a soap; said water soluble polymer is a polyester of polyether polyol having an weight average molecular weight of more than about 1,000 and a polycarboxylic acid, and has a weight average molecular weight of not less than about 20,000.

The water soluble polymer of the present invention is a polyester of a polyether polyol and a polycarboxylic acid.

The polyether polyol used for the production of the polyester is a polyol which can be prepared by the addition of an alkylene oxide to a compound having two active hydrogen atoms in a molecule (referred to as an active hydrogen-containing compound hereinafter). There are exemplified as an alkylene oxide ethylene oxide, propylene oxide, butylene oxide and the like. Mixture of the alkylene oxide may be used. In order to furnish the polyester with a sufficient water solubility it is preferable to use ethylene oxide partially as an alkylene oxide, and preferably more than about 70 percent by weight of the total alkylene oxide. The active hydrogen-containing compound may include alkylene glycols, such as ethylene glycol, propylene glycol, butylene glycol, hexylene glycol and the like; aromatic polyols such as hydroquinone and the like; amines such as ethylamine, hexylamine, cyclohexylamine, benzylamine, aniline, imidazolidine, and the like; amides; mercaptans; and so on. In case the active hydrogen-containing compound contains hetero atoms such as amines, amides or mercaptans, the obtained compound is also included in the conception of "a polyether polyol", though containing the hetero atoms in the molecule.

A preferable polyether polyol is a polyether diol, in the aspect of solubility in water and polymeric ability. A monoalcohol cannot extend the polymer chain, and a triol or a polyol having hydroxyl groups more than 3 is tend to be reticulated and to be insoluble in water.

The polyether polyol itself may contain several kinds of oxyalkylene moieties such as an oxyethylene moiety and an oxypropylene moiety, which may be a block copolymer or a random copolymer.

The polyether polyol can be obtained according to a conventional method, for example, reacting a desirable alkylene oxide or a mixture of two or more kinds of alkylene oxide with two active hydrogen-containing compound(s) in the presence of catalyst, for instance, alkaline catayst such as potassium hydroxide, sodium carbonate or acid catalyst such as boron trifluoride under a suitable pressure such as 0–10 atoms (gauge pressure) at a temperature of, for example, from about 60° to 160 ° C.

Alkaline catalyst for an addition polymerization of the alkylene oxide is especially preferable, because the alkaline catalyst can be also used as a catalyst for a succesive esterification without any elimination process of the catalyst or use of additional catalyst.

The content of the polyoxyethylene moiety in the polyether polyol is preferably more than 50 % by weight, more preferably 70–100 % by weight based on the total weight of the polyether polyol. If the content of the polyoxyethylene moiety is less than 50 %, the water-solubility becomes insufficient.

The polyether polyol should be water soluble, and preferably has a weight average molecular weight of more than about 1,000, more preferably more than about 2,000, most preferably about 3000–50,000 in the aspect of the water solubility and the tear strength.

As aforementioned, the most preferable examples of the polymers for the present invention are polyesters of polyether polyol with polycarboxylic acid. Such polymers can be prepared according to Japanese Patent Application KOKAI No. 56-226018, which is incorporated into the present specification.

Examples of the polycarboxylic acid usable for the preparation of the polyester are aliphatic polycarboxylic acid such as malonic acid, succinic acid, glutaric acid, adipic acid, pimelic acid, suberic acid, azelaic acid, sebacid acid, maleic acid, fumaric acid, mesaconic acid, malic acid, tartaric acid, hexane tricarboxylic acid, and the like; aromatic polycarboxylic acid such as Phthalic acid, isophthalic acid, terephthalic acid, trimellitic acid, pyromellitic acid, 1,5-naphthalenedicarboxylic acid, dimmer acid, and the like. The polycarboxylic acid may be a partially or wholly ester, which can be reacted by ester interchanging reaction, or may be an acid anhydride such as maleic anhydride, phthalic anhydride, pyromellitic dianhydride, and the like. Lower alkyl esters of the polycarboxylic acid are also usable, such as methyl ester, polymethyl ester, mono or polyethyl ester, and the like.

Mixture of the polycarboxylic acid may be used.

Most preferable polycarboxylic acids are phthalic acid, terephthalic acid, isophthalic acid, sebacic acid, pyromellitic acid; lower alkyl esters thereof such as dimethyl esters, diethyl esters; anhydride such as pyromellic dianhydride and the like.

A preferable weight average molecular weight of the polymer such as polyesters of the polyether polyols and the polycarboxylic acid is more than about 10,000 - 500,000. If the molecular weight is less than 10,000, the water-solubility of an obtained polymer film or sheet would be sufficient, but the tear strength will lower and the equiliblium moisture content will exceed the lower limit required, whereas the molecular weight of more than 500,000 will decrease the water-solubility.

The ratio of the polyether polyol and the polycarboxylic acid, ester or acid anhydride is not restrictive so far as the molecular weight of the polyether polyol is not less than 1,000, and that of the obtained polymer is not less than 10,000 and not more than 500,000 is satisfied.

The esterification of the polyether polyol and the polycarboxylic acid, ester, or acid anhydride can be effected by a conventional manner, for example, by heating under reduced pressure in the presence of catalyst such as p-toluene sulfonic acid, boron trifluoride, potassium hydroxide, sodium hydroxide, magnesium hydroxide, alkali methals and the like.

Preferable temperature is about 80°-250 ° C., and preferable pressure is about 0.001-20 Torr. Reaction can be usually completed within 0.5-10 hours. Of course, the reaction may be carried out as removing generated water or lower alcohol by the ventilation of nitrogen gas. But the esterification aforementioned is only a suitable example, and should not be construed restrictively.

The molecular weight may be controlled by the ratio of the polyether polyol and the polycarboxylic acid, or by controlling the reduced pressure. The latter is more practical and easy. As the reaction pressure is lower, a polymer having a larger molecular weight can be obtained.

Though the aforementioned polyesters are most suitable polymers for providing a film-shape soap due to its compatibility with a soap, another water soluble polymers such as methyl cellulose, hydroxyethyl cellulose, hydroxypropyl methyl cellulose, carboxy methyl cellulose, polyvinyl alcohol, polyvinylpyroridon, polyacrylates (e.g. sodium, potassium or ammonium salts) and the like may be mixed therewith. However, as the polymer of the present invention is immiscible with polyvinyl alcohol, and the co-use with cellulose derivatives makes the film highly water-absorbable, the content of another water soluble polymer is preferably less than 10 % by weight of the polymer of the present invention.

A soap which may be used in the present invention is not restricted. Any kinds of fatty acid salts usable for a soap, for instance, a body soap which is directly applied to washing a humane body such as a toilet soap, a bath soap, a medicated soap, a deodorant soap and the like; a laundry soap; a domestic soap such as detergent for a washing machine, for a kitchen, and the like; and a soap for industrial use.

As a fatty acid for the soap may be exemplified a saturated or unsaturated fatty acid, a branched or straight fatty acid or mixture thereof. The fatty acid preferably includes lauric acid, myristic acid, palmitic acid, stearic acid, arachidic acid, oleic acid, elaidic acid, erucic acid, linoleic acid, linolenic acid, ricinoleic acid, 12-hydroxy stearic acid and the like.

The alkali used for forming the soap includes alkaline metal such as sodium, potassium, ammonium, alkanolamines and the like. Most preferable one is sodium.

The soap may be produced according to a conventional process, for instance, by saponification of an oil or a fat such as tallow oil, palm oil, palm kernel oil, a coconut oil, castor oil, lard, hydrogenated fish oil, hydrogenated tallow, and sometimes, cottonseed oil, soybeen oil, peanut oil, olive oil, and the like, most suitable oil is a mixture of tallow and coconut oil; or neutralizing a fatty acid with a suitable alkali.

The weight ratio of the water soluble polymer to the soap may be preferably from about 10/90 to about 80/20, more preferably about 20/80 to about 60/40 in terms of solid.

The content of water in the mixture of the water soluble polymer and the soap may be about 1-about 40 percent by weight, more preferably about 5-about 25 percent by weight based on the total weight of water, water soluble polymer and the soap.

The film-shape soap of the present invention may contain other additives which is usually used in a soap. The additives include a perfume, a deodorant (e.g. phenols, cresols, bisphenols, salicylic acid and the like) a coloring agent, a preservative, a bactericide, a humectant, a plasticizer, an antioxidant, a superfatting agent (an oily material to prevent a skin from excess removal of a fat thereon, e.g. a higher fatty acid, a higher fatty alcohol, lanolin, squalane and the like; or to protect the skin instead of the fat removed therefrom, e.g. a glycerin, glycol, diethylene glycol, lecithin and the like), water softening agents such as chelating agents, lime soap dispersing agents, builders, transparents such as glycerin, rosin soap, sugar, alcohol and the like, redeposition preventing agents such as carboxymethylcellulose, foam stabilizers, defoamers and the like.

The film-shape soap of the present invention may contain other water soluble polymers such as methyl cellulose, hydroxypropyl methyl cellulose, carboxymethylcellulose, hydroxyethyl methyl cellulose, hydroxybutyl methyl cellulose, hydroxy ethyl cellulose, hydroxy propyl cellulose, polyacrylate, pullulan, polyvinyl alcohol, and the like; and additional surfactants other than a soap. In case that the film-shape soap is for a body soap such as a toilet soap, a bath soap, a deodorant soap, and the like, which is most suitable one for the object of the present invention, the content of the additional surfactant prefer as little as possible in most case, but sometimes the addition of a surfactant other than a soap improves the washability, foaming property, soft feeling of a skin, prevention of stimulation and the like. Typical surfactant which may added to the film-shape soap of the present invention is an alkyl ester of α-sulfofatty acid salt, an N-acylglutaminic acid salt, alkyl sulfate, alkylbenzenesulfonate, fatty acid isopropanolamide sulfonate, α-glyceryl monoalkylether-α'-sulfonate, α-acyl-α'-sulfonyldiglyceride, acyl-N-methyltauride, polyoxyethylene alkyl ether, polyoxyethylene alkyl phenol ether, polyoxyethylene alkyl ester, polyoxyethylene alkyl ether sulfate and the like.

The film-shape soap of the present invention may be prepared by kneading a water soluble polymer as aforementioned and soap, and other additives if necessary, and then the mixture is shaped like a film or a sheet (in the present specification both of such a film or a sheet are referred to as a film altogether). In this process it is preferable to use a small shape soap such as powder, granule, pellet, flake, needle and the like. As a conventional kneader, extruder, roll and the like can be used. The process for kneading may be carried out at a temperature that the water soluble polymer and the soap are softened, for instance, about 30°–200° C., more preferably about 50 ° C. to 90 ° C. for about 0.5–1 hour. Of course, the temperature is not restricted to the above, because the melting point of the soap is depended on the kind of salt, the chain length of fatty acid, the content of unsaturated fatty acid, water content and the like. If a soap having a comparatively high moisture content such as 30 percent by weight, the temperature may be lower than 50 ° C.

As a means for shaping a film or sheet rolling extrusion from a T-die, flow-extending and the like are exemplified. The thickness of the film-shape soap of the present invention can be from 10 μm to 500 μm preferably 20 μm to 100 μm.

The film-shape soap of the present invention can be controlled in the thickness, softness, water solubility, tear strength, equilibrium moisture content, soluble time and so on by controlling the water content in the film-shape soap, the ratio of the soap and the water soluble polymer, water solubility of the polymer, kneading condition, kinds of the soap and the polymer, and the like.

According to the present invention a flexible film-shape soap has a high tear strength and a small equilibrium moisture content, which can be easily and rapidly dissolved in water. Therefore, the film-shape soap of the present invention may be used as a portable toilet soap, a disposable soap, a soap for unit usage by cutting the film-shape soap to a suitable size or rolling it. The film-shape soap may be used as a rolling film type.

Illustrating the invention are the following examples, which, however, are not be construed as limiting the invention to their details. All parts and percentages in the examples, as well as throughout this specification are by weight unless otherwise specified.

EXAMPLE 1

Polyethylene glycol (an weight average molecular weight of 10,000) 100 parts and dimethyl terephthalate 2.2 parts were mixed, and heated at about 180° to 190 ° C. for one hour in the presence of catalystic amount of potassium hydroxide as removing produced ethyl alcohol under a reduced pressure of about 0.1 Torr to give a polyester having an average molecular weight of about 130,000 (this compound is referred to as a Polymer A hereinafter).

The Polymer A 20 g and a toilet soap powder which contains sodium salt of $C_{18}$-fatty acid as a main ingredient (water content: 20 % by weight) 20 g were kneaded at 65 ° C. for 20 minutes in a twin-roll mill. The mixture obtained was rolled at 40 ° C. by rolling to give a film-shape soap of 50 μm.

Hand washing test using the film-shape soap prepared in the above process was made by a panel consisting of ten members. Nine members in the panel evaluated that the film-shape soap was equal to the soap, a row material in the washability, and all members in the panel recognized that no insoluble material remained on the hands, and were impressed with an excellent defoamable feeling, moist and refreshing on the skin.

The film has a flexible and a comparatively high tear strength, and is not brittle. After the film was held at 35 ° C. and RH 90 % for one month, the appearance, weight, physical properties (tear strength and water solubility) were not changed. This means that the compatibility of the water soluble polymer of the present invention and the soap is excellent and soap does not bleed out; the polymer is not hydrolyzed with the alkali of the soap; the film-shape soap of the present invention has little absorbability of moisture in atmosphere, but high water solubility when it is immersed into water. Accordingly, the film-shape soap of the present invention is suitable for a portable toilet soap.

EXAMPLE 2

Ethylene oxide 1,900 parts was polymerized onto polypropylene glycol (weight average molecular weight of about 2,000) 100 parts according a usual manner.

The obtained polyether polyol was esterified with dimethyl sebacate 20 parts according to a similar manner as in Example 1 to give a polyester having a weight average molecular weight of 200,000 (referred to as Polymer B hereinafter).

The Polymer B 15 g was mixed with an industrial soap (Genbu Marseilles Sekken ® (sodium salt of tallow fatty acid as a main ingredient): available from Dai-Ichi Kogyo Seiyaku Co., Ltd.), a needle like material, 25 g was roughly mixed, and then the mixture was charged into a small extruding through a kneading zone kept at 65° C., and passed through a T die to give a film-shape soap of 70 μm thickness.

The above film-shape soap was evaluated by ten members in a panel according to similar manner as in Example 1. All members answered that the washability and the feeling during and after the use of the film-shape soap were not inferior to the soap itself used as a raw material.

COMPARATIVE EXAMPLE

A soap used in the Example 1 50 g was mixed with an aqueous solution of methyl cellulose (2% solution) 100 g at 30° C., and flowed on a glass plate. The mixture on the glass plate was dried at 100° C. to give a film-shape soap of soap content of about 60 percent by weight and a thickness of about 50 μm.

This film-shape soap contains bubbles therein due to foams generating at the film production.

The above film soap contains bubbles therein due to foams generating at the film production.

The above film-shape soap was evaluated by ten members in a panel according to similar manner as in Example 1. All members answered that the film was hard, brittle, worse solubility and worse feeling or touch at use and after use.

What is claimed is:

1. A film-shape soap which comprises (a) a water soluble polymer and (b) a soap; said water soluble polymer is a polyester of polyether polyol having an weight average molecular weight of more than about 1,000 and a polycarboxylic acid, and has a weight average molecular weight of not less than about 20,000.

2. A film-shape soap of the claim 1, in which the polymer is a polyester having a polyoxyethylene moiety.

3. A film-shape soap of the claim 1, in which the polymer is an ester of polyalkylene glycol having a weight average molecular weight of about 1000 to 50000 and polycarboxylic acid selected from the group consisting of terephthalic acid, phthalic acid, isophthalic acid, sebacic acid and pyromellitic acid.

4. A film-shape soap of the claim 1, in which the ratio of the water soluble polymer and the soap is from about 20:80 to about 60:40 by weight in terms of solid.

5. A film-shape soap of the claim 1, in which the film has a thickness of from about 10 μto 500 μm.

* * * * *